US005368089A

United States Patent [19]

Reynolds et al.

[11] Patent Number: 5,368,089

[45] Date of Patent: Nov. 29, 1994

[54] DEVICE FOR COOLING MOLTEN MATERIAL

[75] Inventors: Timothy Reynolds, Cockermouth; Robert M. Perry, Whitehaven; David A. Preshaw, Workington, all of England

[73] Assignee: Davy (Distington) Limited, Workington, England

[21] Appl. No.: 934,612

[22] PCT Filed: Mar. 12, 1991

[86] PCT No.: PCT/GB91/00385

§ 371 Date: Sep. 11, 1992

§ 102(e) Date: Sep. 11, 1992

[87] PCT Pub. No.: WO91/13710

PCT Pub. Date: Sep. 19, 1991

[30] Foreign Application Priority Data

Mar. 12, 1990 [GB] United Kingdom ..... 9005539.3

[51] Int. Cl.[5] ..... B22D 11/10; B22D 27/04; B22D 41/005

[52] U.S. Cl. ..... 164/443; 164/348; 266/241

[58] Field of Search ..... 164/443, 348, 485, 122, 164/127; 222/592; 266/46, 241

[56] References Cited

U.S. PATENT DOCUMENTS

| | | | |
|---|---|---|---|
| 3,658,116 | 4/1972 | Hunt | 164/485 X |
| 4,854,968 | 8/1989 | Otsuka et al. | 266/241 X |
| 4,858,671 | 8/1989 | Hesterberg et al. | 164/127 X |
| 5,005,632 | 4/1991 | Henderson et al. | 164/122 X |
| 5,040,590 | 8/1991 | Brandriff | 164/127 X |

FOREIGN PATENT DOCUMENTS

| | | | |
|---|---|---|---|
| 194274 | 5/1967 | U.S.S.R. | 164/127 |
| 1574359 | 6/1990 | U.S.S.R. | 164/122 |

*Primary Examiner*—J. Reed Batten, Jr.

*Attorney, Agent, or Firm*—Lee, Mann, Smith, McWilliams, Sweeney & Ohlson

[57] ABSTRACT

The device comprises a body of thermally conductive material having an upper part through which liquid coolant is passed and a lower part which is submerged in the molten metal to be cooled. The lower part has a dimension which is greater than the corresponding dimension in a higher horizontal cross-sectional plane so that a skull of solidified metal is locked to the body by extending around the greater dimension.

11 Claims, 7 Drawing Sheets

DEVICE FOR COOLING MOLTEN MATERIAL

This invention relates to a device for removing heat energy from a mass of molten material, such as molten metal.

A particular, but not sole, application of the invention is to a device for cooling molten metal which is to be cast in a continuous casting mould. If the molten metal is allowed to flow into the continuous casting mould at a temperature above a predetermined level, the mould may not be able to cool the metal sufficiently to enable a skin of adequate thickness to form on the mould walls and for the wall thickness of the skin at the outlet end of the mould to be sufficiently strong to retain the molten core of the casting. Furthermore, the metallurgical structure quality of the solidified metal is often inferior if molten metal at too high a temperature is used. The device of the invention serves to reduce the temperature of the molten metal to the predetermined level if necessary. The device can be used on the molten metal before it enters the continuous casting mould or it can be used with the molten metal in the continuous casting mould.

It is known from French Patent Publication No. 2526340 for one or more water cooled devices to be dipped into the molten metal in a vertical continuous casting mould in order to withdraw heat energy from the molten metal thereby encouraging the molten metal to commence solidification. In the French publication the device comprises a generally vertical elongate body having a rounded lower end and a water passage extending through the body from the upper end to a position adjacent the lower end and back to the upper end. In use, water is caused to continuously flow through the passage to bring about cooling of the body.

In Japanese Publication No. 51-86024 a similar water-cooled device is used in a tundish upstream of a continuous casting mould.

It is also known from Japanese Patent Publication No. 61-132244 for a heat pipe to be dipped into molten metal in a vertical continuous casting mould and the heat pipe is protected by a heat-resistive shield with a low melting point metal between the outer surface of the heat pipe and the shield. In use, the low melting point metal melts to form a liquid heat transfer medium between the heat-resistant shield and the heat pipe. The part of the cooled device which is in contact with the molten metal will extract some heat from the molten metal causing a thin layer of skull to be formed on the surface of the device.

According to the present invention, a device comprises a body of thermally conductive material having a duct therein for the passage of liquid coolant therethrough and means for supporting the body so that, in use, a part of the body is submerged in the molten metal to be cooled, characterised in that the body comprises an upper part and a lower part which, in use, is submerged in the molten metal, said lower part having a dimension in a horizontal cross-sectional plane which is greater than the corresponding dimension in a higher horizontal cross-sectional plane of the lower part whereby, in use, a skull of solidified metal which forms on the submerged part of the body is locked to the body by extending around said greater dimension, and the duct for liquid coolant is entirely within the upper part of the body which is not arranged to be submerged in the molten metal.

By arranging for the liquid coolant to be associated with the part of the body which is above the surface of the molten metal, the danger of the cooling liquid coming into contact with the molten metal in the event of a fracture of the submerged part of the body is considerably reduced since the cooling liquid does not enter the part of the body which is submerged in the molten metal.

By arranging for the part of the body which is submerged in the molten metal to have a greater dimension in a horizontal cross-sectional plane positioned at a level below a horizontal cross-sectional plane of smaller dimension, the skull which forms on the surface of the submerged part of the body locks on to the body around the greater dimension and thus prevents portions of the skull from coming adrift from the body and mixing with the molten metal. As the body expands and the skull contracts, the skull makes intimate contact with the body.

Clearly, the amount of heat withdrawn from the molten metal by the device will depend on the area of the part of the body which is submerged in the molten metal and the degree of cooling applied to the body. Furthermore, the amount of heat withdrawn from the molten metal depends upon the thickness of the skull on the body. The thicker the skull, the smaller the amount of heat which is removed from the molten metal.

As the molten metal in the vessel flows past the cooler, some solidified dendrites of the metal skull which may be adhering to the body are caused to break loose into, and be carried away by, the flow of molten metal adjacent to the device, thereby acting as nuclei for subsequent solidification dependent on the temperature of the molten metal. The body may be vibrated using a source of variable frequency vibrations to add to this effect. Vibrations whose peak velocity is at least 10 mm/sec and has a frequency of at least 100 Hz will be beneficial.

By removing heat energy from the molten metal, the overall temperature will be reduced towards or below the material liquidus temperature. By removing sufficient heat energy from the molten metal, some generation of solid fraction will occur.

In order that the invention may be more readily understood, it will now be described, by way of example only, with reference to the accompanying drawings, in which.

Figure 1:
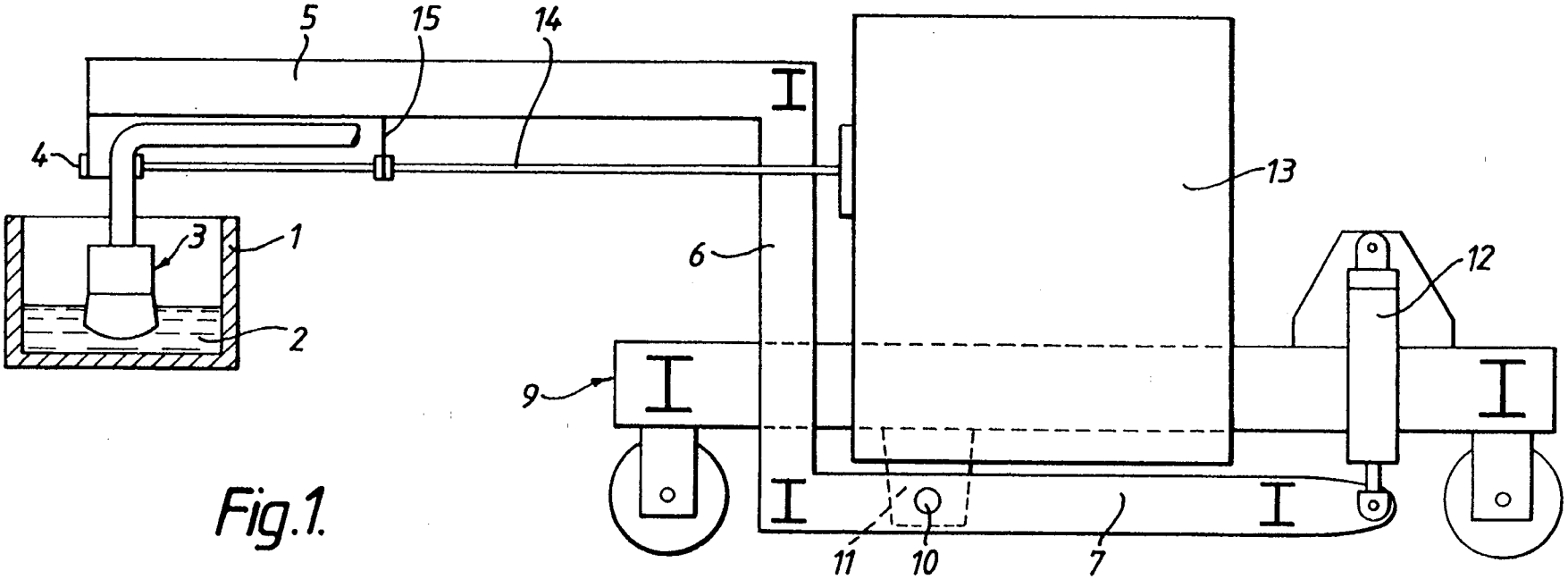
FIG. 1 is a somewhat diagrammatic side elevation of apparatus in accordance with one aspect of the present invention.

Referring particularly to FIG. 1, an open-topped tundish is indicated generally by reference numeral 1. The tundish contains a flowing molten metal 2 and, in order to cool the molten metal, a cooling device 3 in accordance with the present invention is dipped into the molten metal. The device is water-cooled so that, when it is dipped into the molten metal, heat will flow from the molten metal through the device into the liquid coolant. The form of the device 3 will be described in detail below, but FIG. 1 shows that the device is supported by a support member 4 resiliently supported from a crossbeam 5 overlying the tundish 1. The beam 5 is cantilevered from a vertical post 6 which, in turn, is connected to one end of a horizontal beam 7. The horizontal beam 7 is located beneath a wheeled carriage 9 and is pivoted to the carriage by way of a horizontal pivot 10 extending from a pair of downwardly extending lugs 11. The free end of the beam 7 is connected to a piston-cylinder device 12 which has its upper end secured to the carriage. By operating the piston-cylinder device 12, the beam 7 is caused to pivot in the vertical plane about the horizontal pivot 10 and this, in turn, causes the beam 5 to pivot in the vertical plane so that the depth to which the device 3 can be dipped into the molten metal 2 is adjustable. Also mounted on the carriage 9 is a vibration generator 13 from which a generally horizontal rod 14 extends. This rod is suspended from the horizontal beam 5 by a spring steel support 15 and is connected to the support member 4. In use, the vibrator can produce vibrations on the rod 14 of a wide range of frequencies and amplitudes and the resilient support for the rod 14 permits the rod to be vibrated relative to the beam 5. The vibrations applied to the rod are applied to the device 3.

Figure 1A:
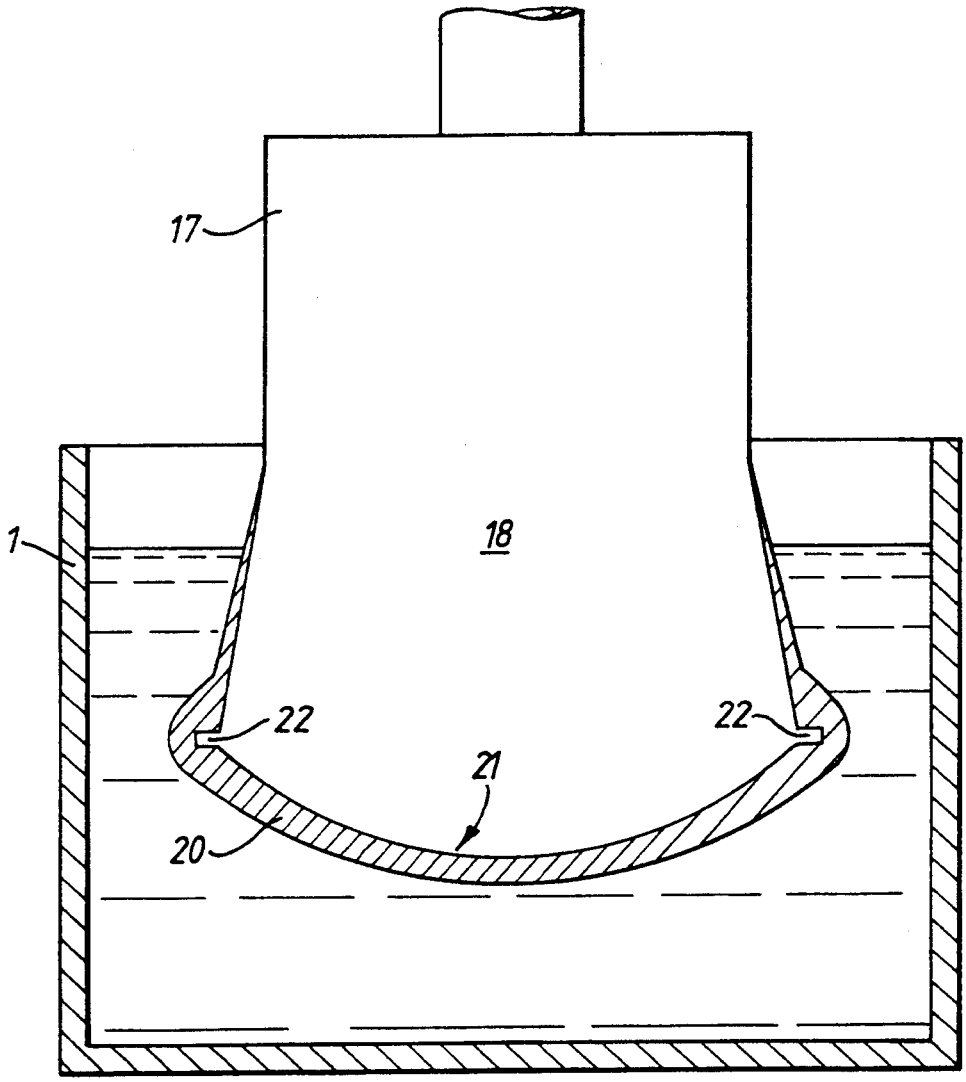
FIG. 1A is an enlargement of the cooling device shown in FIG. 1.

Referring to FIG. 1A, an example of the way in which the device operates to cool molten metal will be explained. The device consists of a body of thermally conductive material, such as steel. The body has an upper part 17 by which it is supported and a lower part 18 which, in use, is arranged to dip into the molten metal to be cooled. As shown in FIG. 1A, the part 18 is of generally dove-tail cross-section in the vertical plane. The body is water cooled in a manner to be described later and, when the lower part of the body is dipped into the molten metal, a skull of metal 20 forms on the submerged surface of the body. The submerged part of the body has a horizontal dimension in a horizontal cross-sectional plane adjacent its lower end which is greater than the corresponding dimension in a horizontal plane above it so that, when the skull is formed on the body, it is locked on to the body, since it extends around the part of the body having the greater dimension in the horizontal plane, and is in contact with the part of the body above the part of the body where the greater dimension occurs. In this way, the skull cannot fall from the body since it cannot move past the part of greater dimension. The wall 21 of the body below the part of maximum dimension may be flat, or it may be of convex form, as shown in the figure. If desired a pair of outwardly extending horizontally disposed projections 22 may be located at the region of the body having the maximum dimension so that, when the body has been withdrawn from the molten metal and it is desirable to remove the skull, the skull is cut away along the projections 22 and the two parts of the skull can then be easily removed from the body.

Figure 2:
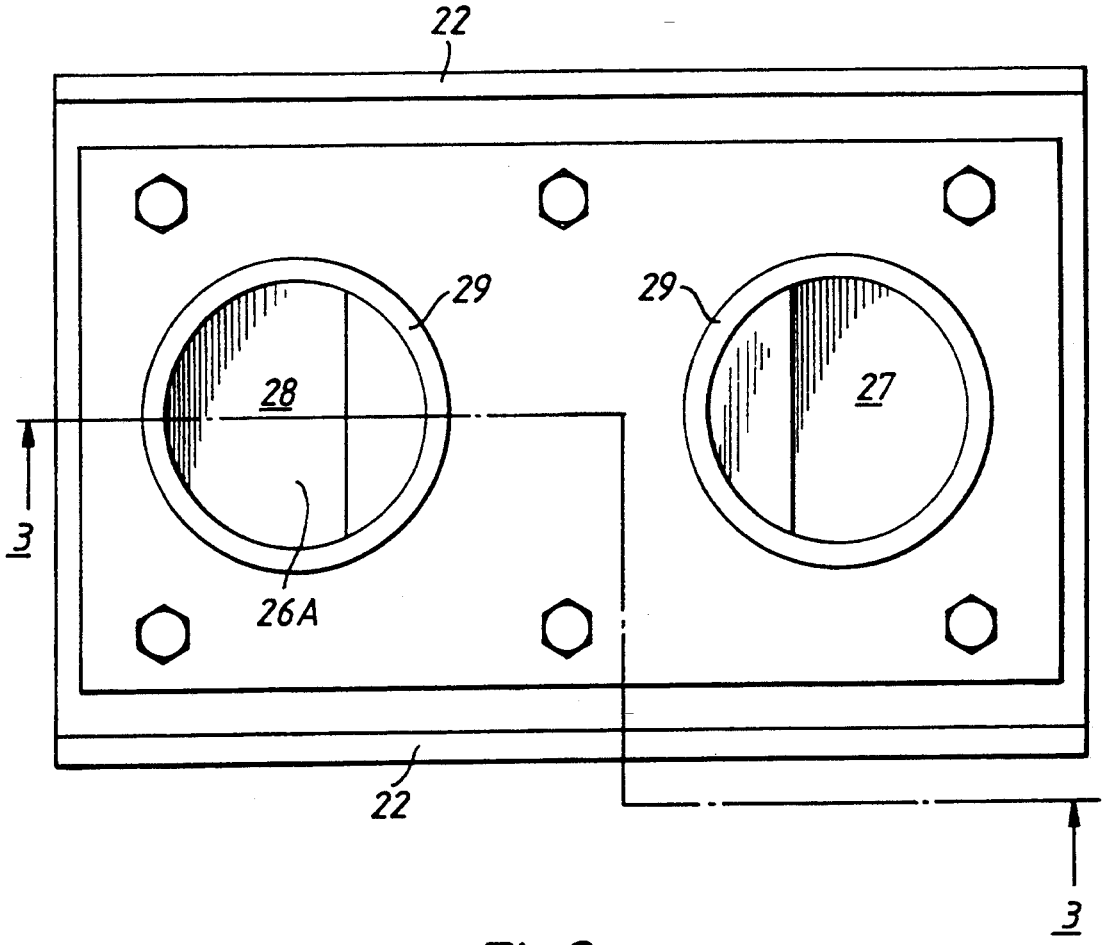
FIG. 2 is a plan view of a cooling device shown in FIG. 1.
Figure 3:
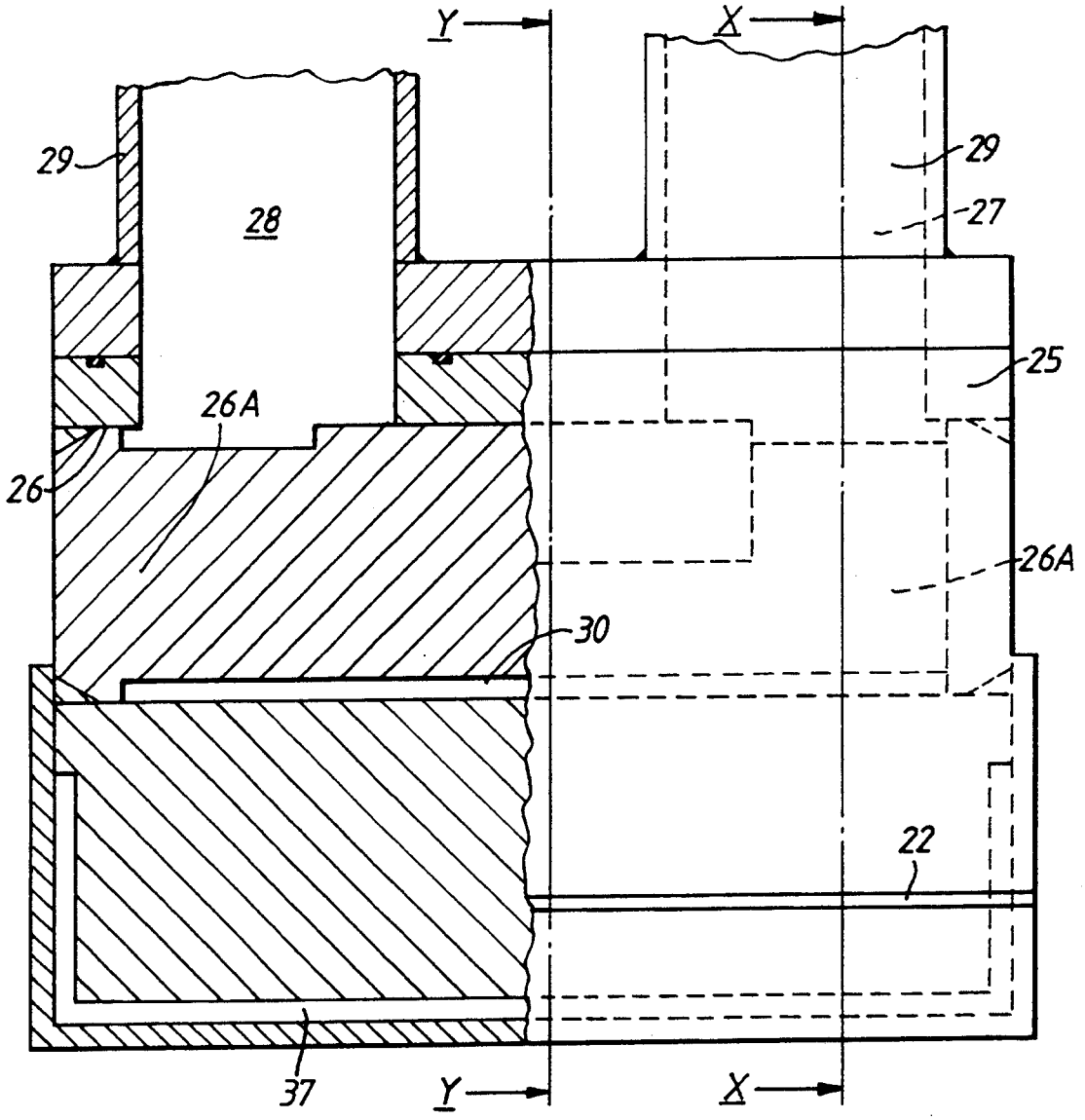
FIG. 3 is a part section on the line 3—3 of FIG. 2.
Figure 4:
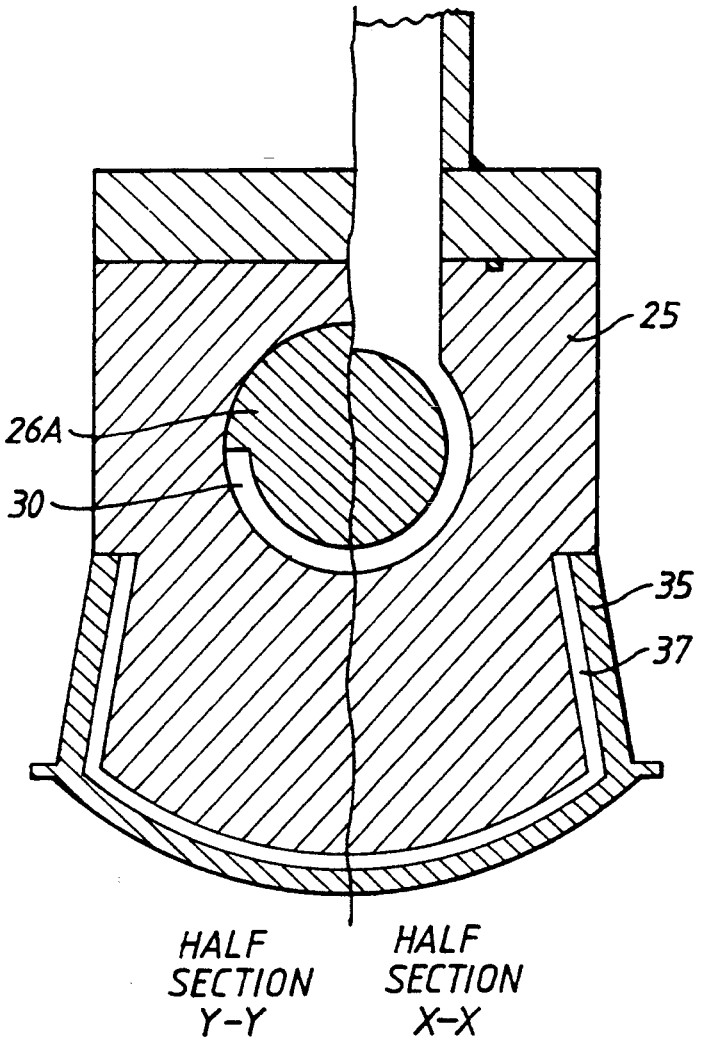
FIG. 4 is a section on the lines X—X and Y—Y of FIG. 3.

FIGS. 2, 3, and 4 show a preferred form of the body. The body is of generally rectangular form in plan view. The upper part of the body, that is the part which is not adapted to be submerged in the molten metal, is in the form of a block 25 having a horizontally disposed opening 26 therethrough. This opening is in communication with a pair of further vertical openings 27, 28 extending to the top of the block. Annular pipe connections 29 are secured to the block surrounding the openings. The openings through the block form a duct for the passage of liquid coolant, usually water, through the upper part of the block. The passage 26 through the block has a generally cylindrical restrictor 26A located in it, the restrictor being of a form which reduces the cross-section of the passage 26 but which connects the passage 26 to the two vertical openings 27, 28, as shown in FIGS. 3 and 4. As shown on the cross-section X—X, beneath each of the openings the restrictor is shaped so that coolant liquid passing along the passage 27, 28 flows around the restrictor 26A and beneath it, whereas the section Y—Y indicates that, in the body between the two vertical openings 27, 28, the restrictor closes off most of the opening 26 except for a U-shaped channel 30 defined by the underside of the restrictor and the adjacent wall of the opening 26. The openings 26, 27, 28 together constitute a duct for the passage of liquid coolant through the upper part of the body. It will be appreciated that the liquid coolant does not enter the part of the body which is adapted to be submerged into the molten metal.

Figure 5:
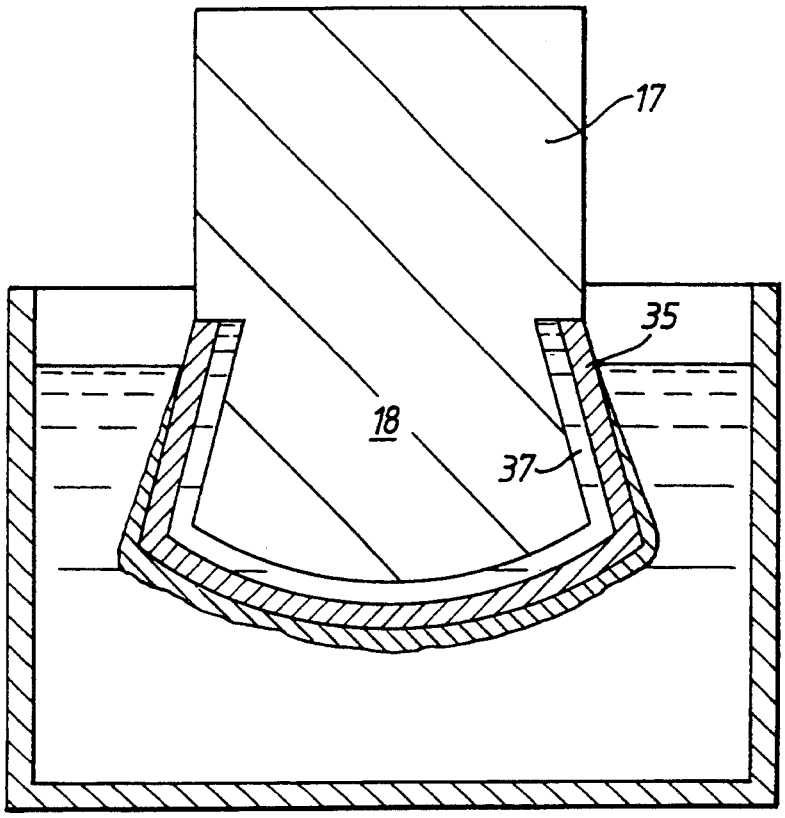
FIGS. 5 and 6 show diagrammatically alternative forms of the device.
Figure 6:
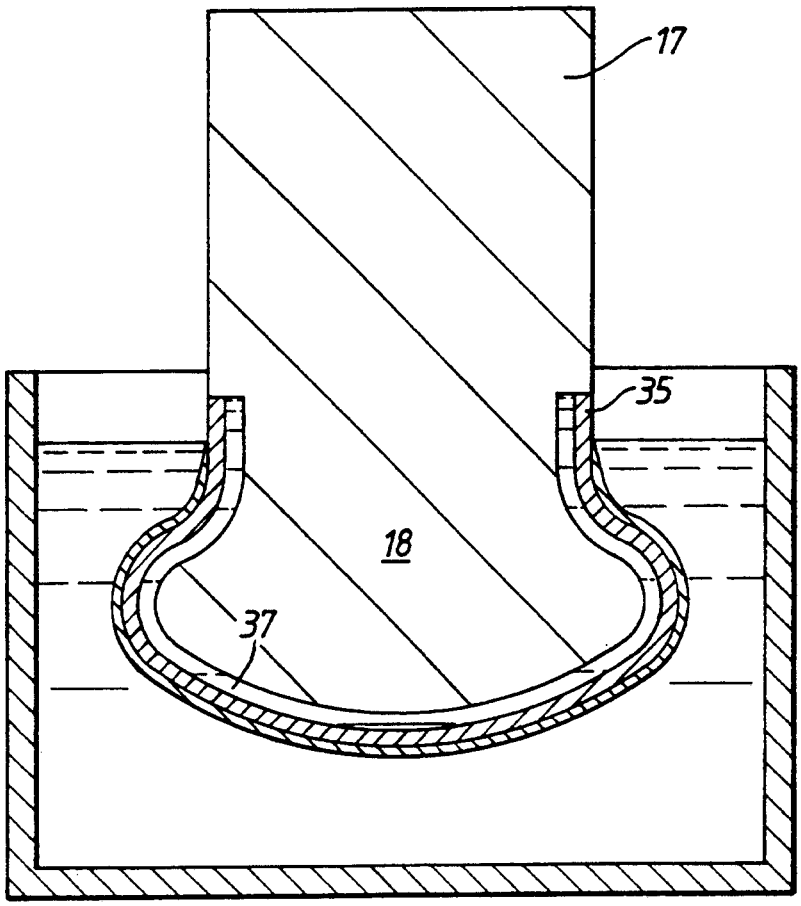

In the arrangement shown in FIG. 5, the lower part of the body 18 is similar in cross-section to that shown in FIG. 1A, but, in FIG. 6, there is shown a device where the lower end of the body is of bulbous form.

In the embodiments of the invention shown in FIGS. 4, 5 and 6, the outer surface of the lower part of the body which is dipped into the molten metal is provided by a separate outer skin 35 which fits on to the body 18 but which is separated therefrom by a sheath 37 of a different material. The material of the skin 35 is one which has a higher melting temperature than that of the molten material into which the device is to be dipped. Between the skin 35 and the body, the intermediate material 37 is one having a lower melting point and higher vaporisation temperature than the molten metal into which the device is to be dipped. When the metal to be cooled is liquid steel, the outer skin 35 is conveniently of molybdenum and the intermediate material is aluminium. This means that, in use, when the body is dipped into the molten metal, the sheath 37 becomes largely molten providing a continuous heat flux path between the outer skin 35 and the part 18 of the water cooled body.

Figure 7A:
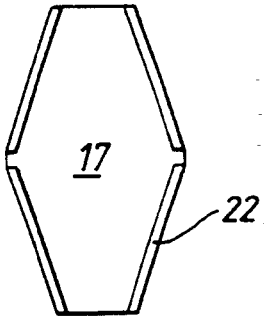
FIGS. 7A, 7B and 7C are alternative plan views to that shown in FIG. 2.
Figure 7B:
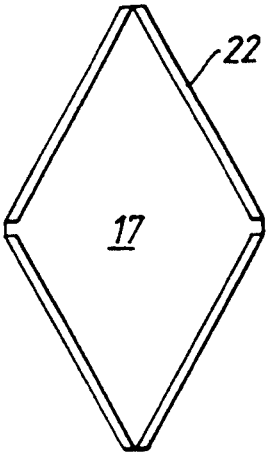
Figure 7C:
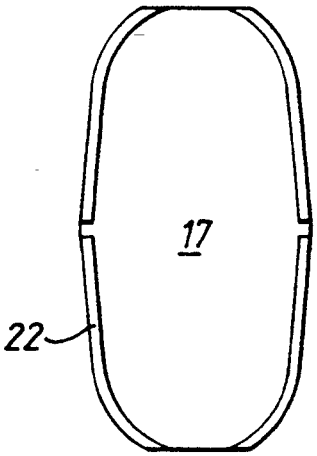

Referring now to FIGS. 7A to 7C, these show plan views of alternative forms of the device.

As shown in FIG. 2, the device may be of generally rectangular form in plan, whereas, FIGS. 7A to 7C show that the device can be of alternative form in plan, but it is convenient for the horizontal projections 22 to be provided in each of the embodiments. In FIGS. 7A to 7C, the water inlet and outlet pipes 29 have been omitted for the sake of clarity.

We claim:

1. A non-rotatable device for cooling molten metal comprising a body of thermally conductive material having an upper part and a lower part, a duct in the upper part of the body for the passage of liquid coolant therethrough, said lower part of the body having no provision for the passage of liquid coolant therethrough, said lower part having a dimension in a first horizontal cross-sectional plane which is grater than the corresponding dimension in a second horizontal cross-sectional plane which is above the first cross-sectional plane, and means for supporting the body so that, in use, the upper part is not submerged in the molten metal to be cooled but the lower part is submerged in the molten metal to be cooled and a skull of solidified metal which forms on the submerged part of the body is locked to the body by extending around the dimension in the first horizontal cross-sectional plane.

2. A device as claimed in claim 1, wherein the lower part of the body is of dove-tail cross-section in the vertical plane.

3. A device as claimed in claim 1, wherein a pair of horizontally extending projections are provided on opposite sides of the body at the first horizontal cross-sectional plane.

4. A device as claimed in claim 2, wherein the lower part of the body has a bottom wall which is flat.

5. A device as claimed in claim 2, wherein the lower part of the body has a bottom wall which is convex.

6. A device as claimed in claim 1, wherein the lower part of the body is of bulbous cross-section in the vertical plane.

7. A device as claimed in claim 1, wherein the lower part of the body is sheathed by an outer skin with an intermediate layer between the outer skin and the body, said outer skin being of a material which has a higher melting temperature than the molten metal in which the device is to be submerged and the intermediate layer is of a material having a lower melting point and higher vaporisation temperature than the molten metal in which the device is to be submerged.

8. A device as claimed in claim 7, wherein the outer skin is of molybdenum and the intermediate layer is of aluminium.

9. A device as claimed in claim 1, wherein the body is supported by a support structure which enables the vertical position of the body in the molten metal to be adjusted.

10. A device as claimed in claim 9, wherein the device is supported by a support member forming part of the support structure, said support member being connected to a vibrator whereby vibration is applied to the device.

11. A device as claimed in claim 10, wherein the frequency of vibration is at least 100 Hz and the peak velocity is at least 10 mm/sec.

* * * * *